US008400245B2

(12) United States Patent
Yan et al.

(10) Patent No.: US 8,400,245 B2
(45) Date of Patent: Mar. 19, 2013

(54) HIGH CURRENT MAGNETIC COMPONENT AND METHODS OF MANUFACTURE

(75) Inventors: Yipeng Yan, Shanghai (CN); Robert James Bogert, Lake Worth, FL (US); Guo Ouyang, Guangdong (CN); Zhigang Cheng, Jinagxi (CN)

(73) Assignee: Cooper Technologies Company, Houston, TX (US)

( * ) Notice: Subject to any disclaimer, the term of this patent is extended or adjusted under 35 U.S.C. 154(b) by 303 days.

(21) Appl. No.: 12/535,981

(22) Filed: Aug. 5, 2009

(65) Prior Publication Data

US 2010/0013587 A1 Jan. 21, 2010

Related U.S. Application Data

(63) Continuation-in-part of application No. 12/247,821, filed on Oct. 8, 2008.

(60) Provisional application No. 61/080,115, filed on Jul. 11, 2008.

(51) Int. Cl.

| | |
|---|---|
| ***H01F 27/29*** | (2006.01) |
| ***H01F 27/02*** | (2006.01) |
| ***H01F 21/06*** | (2006.01) |
| ***H01F 27/28*** | (2006.01) |
| ***H01F 27/30*** | (2006.01) |

(52) U.S. Cl. ..... 336/192; 336/83; 336/131; 336/184; 336/186; 336/196

(58) Field of Classification Search ..... 336/192
See application file for complete search history.

(56) References Cited

U.S. PATENT DOCUMENTS

| | | | | |
|---|---|---|---|---|
| 5,500,629 | A | 3/1996 | Meyer | |
| 6,114,939 | A | 9/2000 | Wittenbreder | |
| 6,392,525 | B1 | 5/2002 | Kato et al. | |
| 7,525,406 | B1 * | 4/2009 | Cheng | 336/83 |
| 2001/0043135 | A1 | 11/2001 | Yamada et al. | |
| 2003/0184423 | A1 | 10/2003 | Holdahl et al. | |
| 2004/0017276 | A1 | 1/2004 | Chen et al. | |
| 2004/0113741 | A1 * | 6/2004 | Li et al. | 336/212 |
| 2005/0174207 | A1 | 8/2005 | Young et al. | |
| 2006/0049906 | A1 | 3/2006 | Liu et al. | |
| 2006/0145800 | A1 * | 7/2006 | Dadafshar et al. | 336/82 |
| 2007/0159289 | A1 * | 7/2007 | Lee et al. | 336/212 |
| 2007/0252669 | A1 * | 11/2007 | Hansen et al. | 336/212 |
| 2009/0058588 | A1 | 3/2009 | Suzuki et al. | |
| 2009/0179723 | A1 | 7/2009 | Ikriannikov et al. | |
| 2010/0007453 | A1 | 1/2010 | Yan et al. | |

FOREIGN PATENT DOCUMENTS

| | | | |
|---|---|---|---|
| EP | 1486991 | A1 | 12/2004 |
| EP | 1526556 | A1 | 4/2005 |
| JP | 6423121 | | 2/1989 |
| WO | 2005008692 | A2 | 1/2005 |
| WO | 2008008538 | A2 | 1/2008 |

OTHER PUBLICATIONS

International Search Report and Written Opinion of PCT/US2010/032803; Aug. 23, 2010; 16 pages.
International Search Report and Written Opinion of PCT/US2010/032992; Jul. 28, 2010; 15 pages.

* cited by examiner

*Primary Examiner* — Mohamad Musleh
*Assistant Examiner* — Ronald Hinson
(74) *Attorney, Agent, or Firm* — Armstrong Teasdale LLP

(57) ABSTRACT

Magnetic components including pre-formed clips are described that are more amenable to production on a miniaturized scale. Discrete core pieces can be assembled with pre-formed coils and physically gapped from one another with more efficient manufacturing techniques.

10 Claims, 11 Drawing Sheets

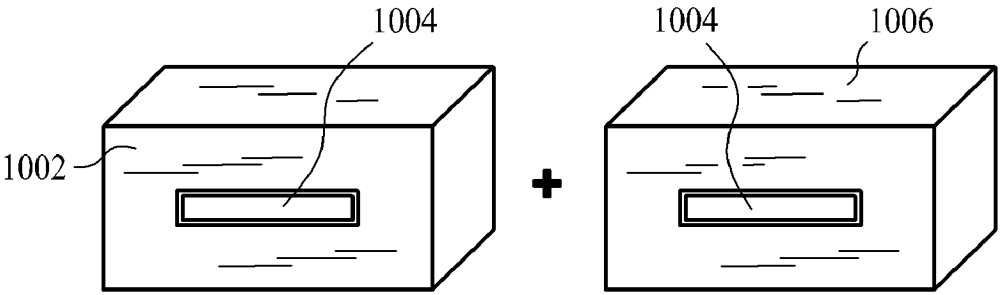
FIG. 22A
+
FIG. 22B
=
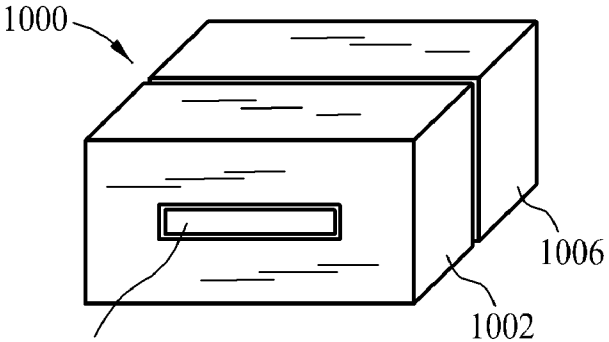
FIG. 22C
FIG. 22

HIGH CURRENT MAGNETIC COMPONENT AND METHODS OF MANUFACTURE

CROSS REFERENCE TO RELATED APPLICATIONS

This application is a continuation in part application of U.S. application Ser. No. 12/247,821 filed Oct. 8, 2008, and claims the benefit of U.S. Provisional Patent Application No. 61/080,115 filed Jul. 11, 2008, the disclosures of which are hereby incorporated by reference in their entirety.

The present application also relates to subject matter disclosed in the following commonly owned and co-pending patent applications: U.S. patent application Ser. No. 12/429,856 filed Apr. 24, 2009 and entitled "Surface Mount Magnetic Component Assembly"; U.S. patent application Ser. No. 12/247,281 filed on Oct. 8, 2008 and entitled "High Current Amorphous Powder Core Inductor"; U.S. patent application Ser. No. 12/138,792 filed Jun. 13, 2008 and entitled "Miniature Shielded Magnetic Component"; U.S. patent application Ser. No. 12/181,436, entitled "A Magnetic Electrical Device" and filed on Jul. 29, 2008; and U.S. patent application Ser. No. 11/519,349 filed Jun. Sep. 12, 2006 and entitled "Low Profile Layered Coil and Cores for Magnetic Components".

TECHNICAL FIELD

The invention relates generally to electronic components and methods of manufacturing these components and, more particularly, to inductors, transformers, and the methods of manufacturing such items.

BACKGROUND

Typical inductors may include toroidal cores and shaped-cores, including a shield core and drum core, U core and I core, E core and I core, and other matching shapes. The typical core materials for these inductors are ferrite or normal powder core materials, which include iron (Fe), Sendust (Al—Si—Fe), MPP (Mo—Ni—Fe), and HighFlux (Ni—Fe). The inductors typically have a conductive winding wrapped around the core, which may include, but is not limited to a magnet wire coil that may be flat or rounded, a stamped copper foil, or a clip. The coil may be wound on the drum core or other bobbin core directly. Each end of the winding may be referred to as a lead and is used for coupling the inductor to an electrical circuit. The winding may be preformed, semi-preformed, or non-preformed depending upon the application requirements. Discrete cores may be bound together through an adhesive.

With the trend of power inductors going toward higher current, a need exists for providing inductors having more flexible form factors, more robust configurations, higher power and energy densities, higher efficiencies, and tighter inductance and Direct Current Resistance ("DCR") tolerance. DC to DC converters and Voltage Regulator Modules ("VRM") applications often require inductors having tighter DCR tolerances, which is currently difficult to provide due to the finished goods manufacturing process. Existing solutions for providing higher saturation current and tighter tolerance DCR in typical inductors have become very difficult and costly and do not provide the best performance from these typical inductors. Accordingly, the current inductors are in need for such improvements.

To improve certain inductor characteristics, toroidal cores have recently been manufactured using an amorphous powder material for the core material. Toroidal cores require a coil, or winding, to be wound onto the core directly. During this winding process, the cores may crack very easily, thereby causing the manufacturing process to be difficult and more costly for its use in surface-mount technology. Additionally, due to the uneven coil winding and coil tension variations in toroidal cores, the DCR is not very consistent, which is typically required in DC to DC converters and VRM. Due to the high pressures involved during the pressing process, it has not been possible to manufacture shaped-cores using amorphous powder materials.

Due to advancements in electronic packaging, the trend has been to manufacture power inductors having miniature structures. Thus, the core structure must have lower and lower profiles so that they may be accommodated by the modern electronic devices, some of which may be slim or have a very thin profile. Manufacturing inductors having a low profile has caused manufactures to encounter many difficulties, thereby making the manufacturing process expensive.

For example, as the components become smaller and smaller, difficulty has arisen due to the nature of the components being hand wound. These hand wound components provide for inconsistencies in the product themselves. Another encountered difficulty includes the shape-cores being very fragile and prone to core cracking throughout the manufacturing process. An additional difficulty is that the inductance is not consistent due to the gap deviation between the two discrete cores, including but not limited to drum cores and shielded cores, ER cores and I cores, and U cores and I cores, during assembly. A further difficulty is that the DCR is not consistent due to uneven winding and tension during the winding process. These difficulties represent examples of just a few of the many difficulties encountered while attempting to manufacture inductors having a miniature structure.

Manufacturing processes for inductors, like other components, have been scrutinized as a way to reduce costs in the highly competitive electronics manufacturing business. Reduction of manufacturing costs is particularly desirable when the components being manufactured are low cost, high volume components. In a high volume component, any reduction in manufacturing cost is, of course, significant. It may be possible that one material used in manufacturing may have a higher cost than another material. However, the overall manufacturing cost may be less by using the more costly material because the reliability and consistency of the product in the manufacturing process is greater than the reliability and consistency of the same product manufactured with the less costly material. Thus, a greater number of actual manufactured products may be sold, rather than being discarded. Additionally, it also is possible that one material used in manufacturing a component may have a higher cost than another material, but the labor savings more than compensates for the increase in material costs. These examples are just a few of the many ways for reducing manufacturing costs.

It has become desirable to provide a magnetic component having a core and winding configuration that can allow one or more of the following improvements, a more flexible form factor, a more robust configuration, a higher power and energy density, a higher efficiency, a wider operating frequency range, a wider operating temperature range, a higher saturation flux density, a higher effective permeability, and a tighter inductance and DCR tolerance, without substantially increasing the size of the components and occupying an undue amount of space, especially when used on circuit board applications. It also has become desirable to provide a magnetic component having a core and winding configuration that can allow low cost manufacturing and achieves more consistent electrical and mechanical properties. Furthermore, it is desirable to provide a magnetic component that tightly controls the DCR over large production lot sizes.

SUMMARY

A magnetic component and a method of manufacturing such a component is described. The magnetic component may include, but is not limited to, an inductor or a transformer. The method comprises the steps of providing at least one shaped-core fabricated from an amorphous powder material, coupling at least a portion of at least one winding to the at least one shaped-core, and pressing the at least one shaped-core with at least a portion of the at least one winding. The magnetic component comprises at least one shaped-core fabricated from an amorphous powder material and at least a portion of at least one winding coupled to the at least one shaped-core, wherein the at least one shaped-core is pressed to at least a portion of the at least one winding. The winding may be preformed, semi-preformed, or non-preformed and may include, but is not limited to, a clip or a coil. The amorphous powder material may be an iron-based amorphous powder material or a nanoamorphous powder material.

According to some aspects, two shaped-cores are coupled together with a winding positioned there between. In these aspects, one of the shaped-cores is pressed, and the winding is coupled to the pressed shaped-core. The other shaped-core is coupled to the winding and the pressed shaped-core and pressed again to form the magnetic component. The shaped-core may be fabricated from an amorphous powder material or a nanoamorphous powder material.

According to other exemplary aspects, the amorphous powder material is coupled around at least one winding. In these aspects, the amorphous powder material and the at least one winding are pressed together to form the magnetic component, wherein the magnetic component has a shaped-core. According to these aspects, the magnetic component may have a single shaped-core and a single winding, or it may comprise a plurality of shaped-cores within a single structure, wherein each of the shaped-cores has a corresponding winding. Alternatively, the shaped-core may be fabricated from a nanoamorphous powder material.

These and other aspects, objects, features, and advantages of the invention will become apparent to a person having ordinary skill in the art upon consideration of the following detailed description of illustrated exemplary embodiments, which include the best mode of carrying out the invention as presently perceived.

BRIEF DESCRIPTION OF THE DRAWINGS

The foregoing and other features and aspects of the invention will be best understood with reference to the following description of certain exemplary embodiments of the invention, when read in conjunction with the accompanying drawings.

FIGS. 6-9 illustrate another magnetic component assembly at various stages of manufacture, wherein:

FIG. 6 illustrates a first core piece and winding subassembly;

FIG. 7 illustrates the core and winding shown in FIG. 6 in assembled form;

FIG. 8 illustrates the assembly of FIG. 7 being assembled with a second core piece.

FIG. 9 shows the completed component assembly in bottom view.

FIGS. 10-13 illustrate another magnetic component assembly at various stages of manufacture, wherein:

FIG. 10 illustrates a first core piece and winding subassembly;

FIG. 11 illustrates the core and winding shown in FIG. 10 in assembled form;

FIG. 12 illustrates the assembly of FIG. 11 being assembled with a second core piece; and FIG. 13 shows the completed component assembly in top view.

FIGS. 14-17 illustrate another magnetic component assembly at various stages of manufacture, wherein:

FIG. 14 illustrates a first core piece and winding subassembly;

FIG. 15 illustrates the core and winding shown in FIG. 15 in assembled form;

FIG. 16 illustrates the assembly of FIG. 16 being assembled with a second core piece.

FIG. 17 shows the completed component assembly in top view.

FIGS. 18-21 illustrate another magnetic component assembly at various stages of manufacture, wherein:

FIG. 18 illustrates a first core piece and winding subassembly;

FIG. 19 illustrates the core and winding shown in FIG. 18 in assembled form;

FIG. 20 illustrates the assembly of FIG. 19 being assembled with a second core piece.

FIG. 21 shows the completed component assembly in top view.

FIG. 22 illustrates another magnetic component assembly in various stages of manufacture, wherein FIG. 22A illustrates a first sectional view of a component subassembly, FIG. 22B illustrates a second sectional view of a component subassembly; and FIG. 22C illustrates a sectional view of a completed component.

DETAILED DESCRIPTION OF EXEMPLARY EMBODIMENTS

Referring to FIGS. 1-5, several views of various illustrative, exemplary embodiments of a magnetic component or device are shown. In an exemplary embodiment the device is an inductor, although it is appreciated that the benefits of the invention described below may accrue to other types of devices. While the materials and techniques described below are believed to be particularly advantageous for the manufacture of low profile inductors, it is recognized that the inductor is but one type of electrical component in which the benefits of the invention may be appreciated. Thus, the description set forth is for illustrative purposes only, and it is contemplated that benefits of the invention accrue to other sizes and types of inductors, as well as other electronic components, including but not limited to transformers. Therefore, practice of the inventive concepts herein is not limited solely to the exemplary embodiments described herein and illustrated in the figures. Additionally, it is understood that the figures are not to scale, and that the thickness and other sizes of the various components have been exaggerated for the purpose of clarity.

Figure 1:
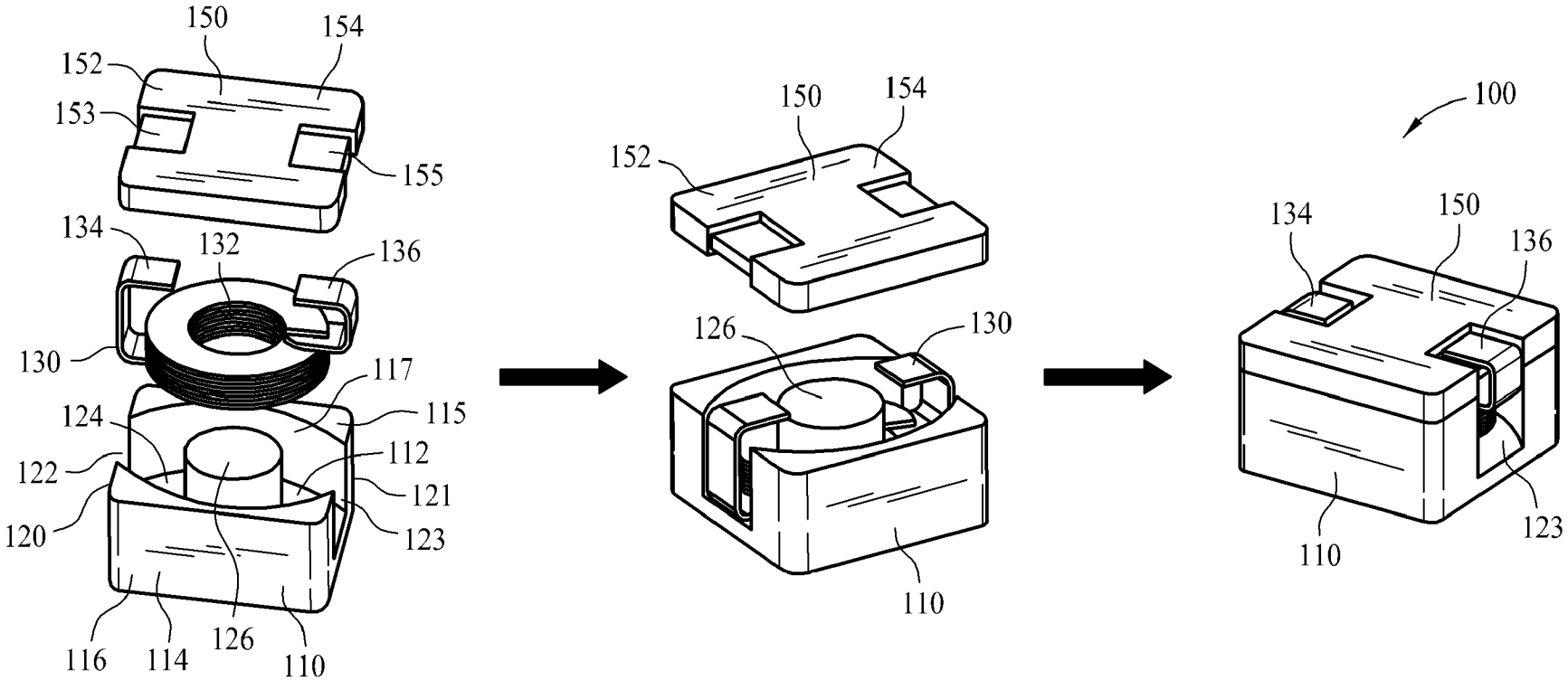
FIG. 1 illustrates a perspective view of a power inductor having an ER-I shaped-core during multiple stages in the manufacturing process, in accordance with an exemplary embodiment.

FIG. 1 illustrates a perspective view of a power inductor having an ER-I shaped-core during multiple stages in the manufacturing process, in accordance with an exemplary embodiment. In this embodiment, the power inductor 100 comprises an ER core 110, a preformed coil 130, and an I core 150.

The ER core 110 is generally square or rectangular in shape and has a base 112, two side walls 114, 115, two end walls 120, 121, a receptacle 124, and a centering projection or post 126. The two side walls 114, 115 extend the entire longitudinal length of the base 112 and have an exterior surface 116 and an interior surface 117, wherein the interior surface 117 is proximate to the centering projection 126. The exterior surface 116 of the two side walls 114, 115 are substantially planar, while the interior surface 117 of the two side walls are concave. The two end walls 120, 121 extend a portion of the width of the base 112 from the ends of each side wall 114, 115 of the base 112, such that a gap 122, 123 is formed in each of the two end walls 120, 121, respectively. This gap 122, 123 may be formed substantially in the center of each of the two end walls 120, 121 such that the two side walls 114, 115 are mirror images of one another. The receptacle 124 is defined by the two side walls 114, 115 and the two end walls 120, 121. The centering projection 126 may be centrally located in the receptacle 124 of the ER core 110 and may extend upwardly from the base 112 of the ER core 110. The centering projection 126 may extend to a height that is substantially the same as the height of the two side walls 114, 115 and the two end walls 120, 121, or the height may extend less than the height of the two side walls 114, 115 and the two end walls 120, 121. As such, the centering projection 126 extends into an inner periphery 132 of the preformed coil 130 to maintain the preformed coil 130 in a fixed, predetermined, and centered position with respect to the ER core 110. Although the ER core is described as having a symmetrical core structure in this embodiment, the ER core may have an asymmetrical core structure without departing from the scope and spirit of the exemplary embodiment.

The preformed coil 130 has a coil having one or more turns, and two terminals 134, 136, or leads, that extend from the preformed coil 130 at 180° from one another. The two terminals 134, 136 extend in an outwardly direction from the preformed coil 130, then in an upward direction, and then back in an inward direction towards the preformed coil 130; thereby each forming a U-shaped configuration. The preformed coil 130 defines the inner periphery 132 of the preformed coil 130. The configuration of the preformed coil 130 is designed to couple the preformed coil 130 to the ER core 110 via the centering projection 126, such that the centering projection 126 extends into the inner periphery 132 of the preformed coil 130. The preformed coil 130 is fabricated from copper and is plated with nickel and tin. Although the preformed coil 130 is made from copper and has nickel and tin plating, other suitable conductive materials, including but not limited to gold plating and soldering, may be utilized in fabricating the preformed coil 130 and/or the two terminals 134, 136 without departing from the scope and spirit of the invention. Additionally, although a preformed coil 130 has been depicted as one type of winding that may be used within this embodiment, other types of windings may be utilized without departing from the scope and spirit of the invention. Additionally, although this embodiment utilizes a preformed coil 130, semi-preformed windings, and non-preformed windings may also be used without departing from the scope and spirit of the invention. Further, although the terminals 134, 136 have been described in a particular configuration, alternative configurations may be used for the terminals without departing from the scope and spirit of the invention. Moreover, the geometry of the preformed coil 130 may be circular, square, rectangular, or any other geometric shape without departing from the scope and spirit of the invention. The interior surface of the two side walls 114, 115 and the two end walls 120, 121 may be reconfigured accordingly to correspond to the geometry of the preformed coil 130, or winding. In the event the coil 130 has multiple turns, insulation between the turns may be required. The insulation may be a coating or other type of insulator that may be placed between the turns.

The I core 150 is generally square or rectangular in shape and substantially corresponds to the footprint of the ER core 110. The I core 150 has two opposing ends 152, 154, wherein each end 152, 154 has a recessed portion 153, 155, respectively, to accommodate an end portion of the terminals 134, 136. The recessed portions 153, 155 are substantially the same width, or slightly larger in width, when compared to the width of the end portion of the terminals 134, 136.

In an exemplary embodiment, the ER core 110 and the I core 150 are both fabricated from an amorphous powder core material. According to some embodiments, the amorphous powder core material can be an iron-based amorphous powder core material. One example of the iron-based amorphous powder core material comprises approximately 80% iron and 20% other elements. According to alternative embodiments, the amorphous powder core material can be a cobalt-based amorphous powder core material. One example of the cobalt-based amorphous powder core material comprises approximately 75% cobalt and 25% other elements. Still, according to some other alternative embodiments, the amorphous powder core material can be a nanoamorphous powder core material.

This material provides for a distributed gap structure, wherein the binder material behaves as gaps within the fabricated iron-based amorphous powder material. An exemplary material is manufactured by Amosense in Seoul, Korea and sold under product number APHxx (Advanced Powder Core), where xx represents the effective permeability of the material. For example, if the effective permeability for the material is 60, the part number is APH60. This material is capable of being used for high current power inductor applications. Additionally, this material may be used with higher operating frequencies, typically in the range of about 1 MHz to about 2 MHz, without producing abnormal heating of the inductor 100. Although the material may be used in the higher frequency range, the material may be used in lower and higher frequency ranges without departing from the scope and spirit of the invention. The amorphous powder core material can provide a higher saturation flux density, a lower hysteresis core loss, a wider operating frequency range, a wider operating temperature range, better heat dissipation and a higher effective permeability. Additionally, this material can provide for a lower loss distributed gap material, which thereby can maximize the power and energy density. Typically, the effective permeability of shaped-cores is not very high due to pressing density concerns. However, use of this material for the shaped-cores can allow a much higher effective permeability than previously available. Alternatively, the nanoamorphous powder material can allow up to three times higher permeability when compared to the permeability of an iron-based amorphous powder material.

As illustrated in FIG. 1, the ER core 110 and the I core 150 are pressed molded from amorphous powder material to form the solid shaped-cores. Upon pressing the ER core 110, the preformed coil 130 is coupled to the ER core 110 in the manner previously described. The terminals 134, 136 of the preformed coil 130 extend through the gaps 122, 123 in the two end walls 120, 121. The I core 150 is then coupled to the ER core 110 and the preformed coil 130 such that the ends of the terminals 134, 136 are coupled within the recessed portions 153, 155, respectively, of the I core 150. The ER core 110, the preformed coil 130, and the I core 150 are then pressed molded together to form the ER-I inductor 100. Although the I core 150 has been illustrated as having recessed portions 153, 155 formed in the two opposing ends 152, 154, the I core 150 may have the recessed portions omitted without departing from the scope and spirit of the invention. Also, although the I core 150 has been illustrated to be symmetrical, asymmetrical I cores may be used, including I cores having mistake proofing, as described below, without departing from the scope and spirit of the invention.

Figure 2:
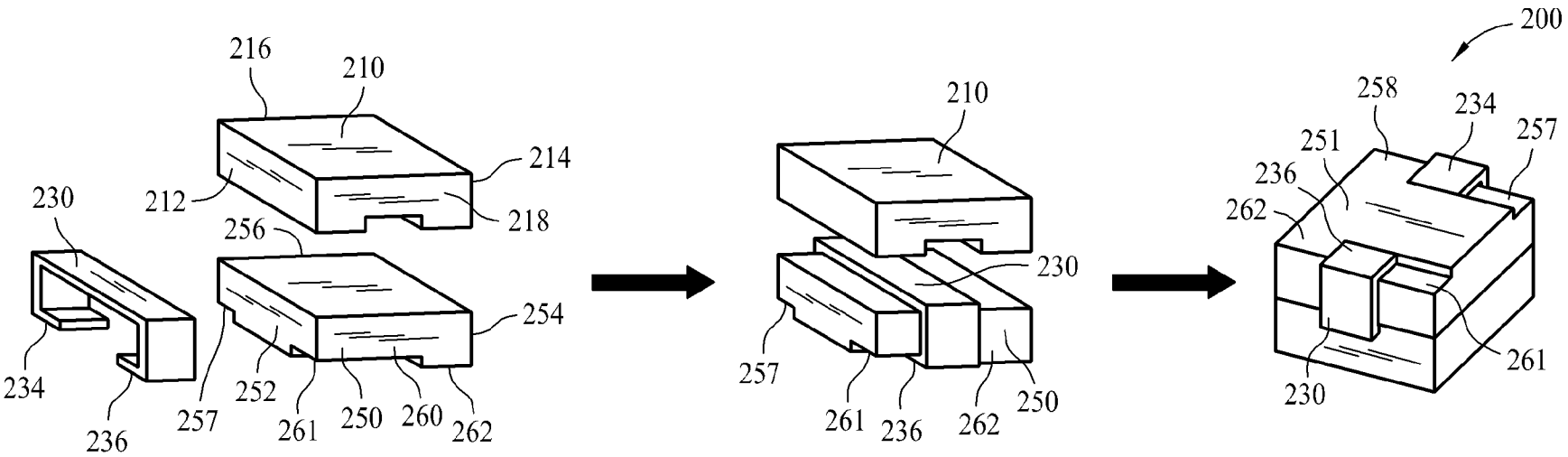
FIG. 2 illustrates a perspective view of a power inductor having a U-I shaped-core during multiple stages in the manufacturing process, in accordance with an exemplary embodiment.

FIG. 2 illustrates a perspective view of a power inductor having a U-I shaped-core, during multiple stages in the manufacturing process, in accordance with an exemplary embodiment. In this embodiment, the power inductor 200 comprises a U core 210, a preformed clip 230, and an I core 250. As used herein and throughout the specification, the U core 210 has two sides 212, 214 and two ends 216, 218, wherein the two sides 212, 214 are parallel with respect to the orientation of the winding, or clip, 230 and the two ends 216, 218 are perpendicular with respect to the orientation of the winding, or clip 230. Additionally, the I core 250 has two sides 252, 254 and two ends 256, 260, wherein the two sides 252, 254 are parallel with respect to the orientation of the winding, or clip, 230 and the two ends 256, 260 are perpendicular with respect to the orientation of the winding, or clip 230. According to this embodiment, the I core 250 has been modified to provide for a mistake proof I core 250. The mistake proof I core 250 has removed portions 257, 261 from two parallel ends 256, 260, respectively at one side 252 of the bottom 251 of the mistake proof I core 250 and non-removed portions 258, 262 from the same two parallel ends 256, 260, respectively, at the opposing side 254 of the mistake proof I core 250.

The preformed clip 230 has two terminals 234, 236, or leads, that may be coupled around the mistake proof I core 250 by positioning the preformed clip 230 at the removed portions 257, 261 and sliding the preformed clip 230 towards the non-removed portions 258, 262 until the preformed clip 230 may not be moved further. The preformed clip 230 can allow better DCR control, when compared to a non-preformed clip, because bending and cracking of platings is greatly reduced in the manufacturing process. The mistake proof I core 250 enables the preformed clip 230 to be properly positioned so that the U core 210 may be quickly, easily, and correctly coupled to the mistake proof I core 250. As shown in FIG. 2, only the bottom 251 of the mistake proof I core 250 provides the mistake proofing. Although only the bottom 251 of the mistake proof I core 250 provides the mistake proofing in this embodiment, alternative sides, either alone or in combination with another side, may provide the mistake proofing without departing from the scope and spirit of the exemplary embodiment. For example, the mistake proofing may be located only at the opposing ends 256, 260 or at the opposing ends 256, 260 and the bottom 251 of the I core, instead of only at the bottom 251 of the I core 250 as depicted in FIG. 2. Additionally, the I core 250 may be formed without any mistake proofing according some alternative embodiments.

The preformed clip 230 is fabricated from copper and is plated with nickel and tin. Although the preformed clip 230 is made from copper and has nickel and tin plating, other suitable conductive materials, including but not limited to gold plating and soldering, may be utilized in fabricating the preformed clip 230 and/or the two terminals 234, 236 without departing from the scope and spirit of the invention. Additionally, although a preformed clip 230 is used in this embodiment, the clip 230 may be partially preformed or not preformed without departing from the scope and spirit of the invention. Furthermore, although a preformed clip 230 is depicted in this embodiment, any form of winding may be used without departing from the scope and spirit of the invention.

Figure 3B:
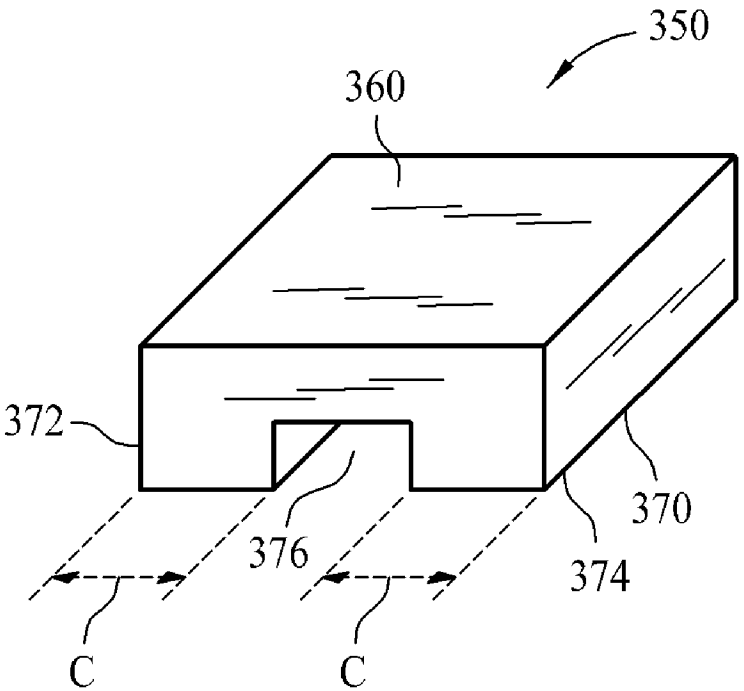
FIG. 3B illustrates a perspective view of an asymmetrical U core in accordance with an exemplary embodiment.
Figure 3A:
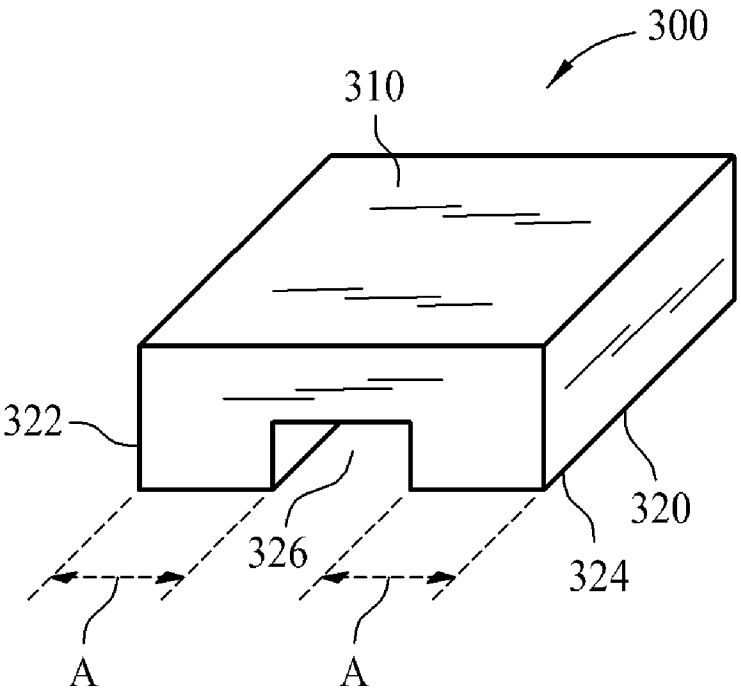
FIG. 3A illustrates a perspective view of a symmetrical U core in accordance with an exemplary embodiment.

The removed portions 257, 261 from the mistake proof I core 250 may be dimensioned such that a symmetrical U core or an asymmetrical U core, which are described with respect to FIG. 3A and FIG. 3B respectively, may be utilized without departing from the scope and spirit of the invention. The U core 210 is dimensioned to have a width substantially the same as the width of the mistake proof I core 250 and a length substantially the same as the length of the mistake proof I core 250. Although the dimensions of the U core 210 have been illustrated above, the dimensions may be altered without departing from the scope and spirit of the invention.

FIG. 3A illustrates a perspective view of a symmetrical U core in accordance with an exemplary embodiment. The symmetrical U core 300 has one surface 310 and an opposing surface 320, wherein the one surface 310 is substantially planar, and the opposing surface 320 has a first leg 322, a second leg 324, and a clip channel 326 defined between the first leg 322 and the second leg 324. In the symmetrical U core 300, the width of the first leg 322 is substantially equal to the width of the second leg 324. This symmetrical U core 300 is coupled to the I core 250, and a portion of the preformed clip 230 is positioned within the clip channel 326. According to certain exemplary embodiments, the terminals 234, 236 of the preformed clip 230 are coupled to the bottom surface 251 of the I core 250. However, in alternative exemplary embodiments, the terminals 234, 236 of the preformed clip 230 may be coupled to the one surface 310 of the U core 300.

FIG. 3B illustrates a perspective view of an asymmetrical U core in accordance with an exemplary embodiment. The asymmetrical U core 350 has one surface 360 and an opposing surface 370, wherein the one surface 360 is substantially planar, and the opposing surface 370 has a first leg 372, a second leg 374, and a clip channel 376 defined between the first leg 372 and the second leg 374. In the asymmetrical U core 350, the width of the first leg 372 is not substantially equal to the width of the second leg 374. This asymmetrical U core 350 is coupled to the I core 250, and a portion of the preformed clip 230 is positioned within the clip channel 376. According to certain exemplary embodiments, the terminals 234, 236 of the preformed clip 230 are coupled to the bottom surface 251 of the I core 250. However, in alternative exemplary embodiments, the terminals 234, 236 of the preformed clip 230 may be coupled to the one surface 360 of the U core 350. One reason for using an asymmetrical U core 350 is to provide a more even flux density distribution throughout the entire magnetic path.

In an exemplary embodiment, the U core 210 and the I core 250 are both fabricated from an amorphous powder core material, which is the same material as described above in reference to the ER core 110 and the I core 150. According to some embodiments, the amorphous powder core material can be an iron-based amorphous powder core material. Additionally, a nanoamorphous powder material may also be used for these core materials. As illustrated in FIG. 2, the preformed clip 230 is coupled to the I core 250, and the U core 210 is coupled to the I core 250 and the preformed clip 230 such that the preformed clip 230 is positioned within the clip channel of the U core 210. The U core 210 can be symmetrical as shown with U core 310 or asymmetrical as shown with U core 350. The U core 210, the preformed clip 230, and the I core 250 are then pressed molded together to form the UI inductor 200. The press molding removes the physical gap that is generally located between the preformed clip 230 and the core 210, 250 by having the cores 210, 250 form molded around the preformed clip 230.

Figure 4:
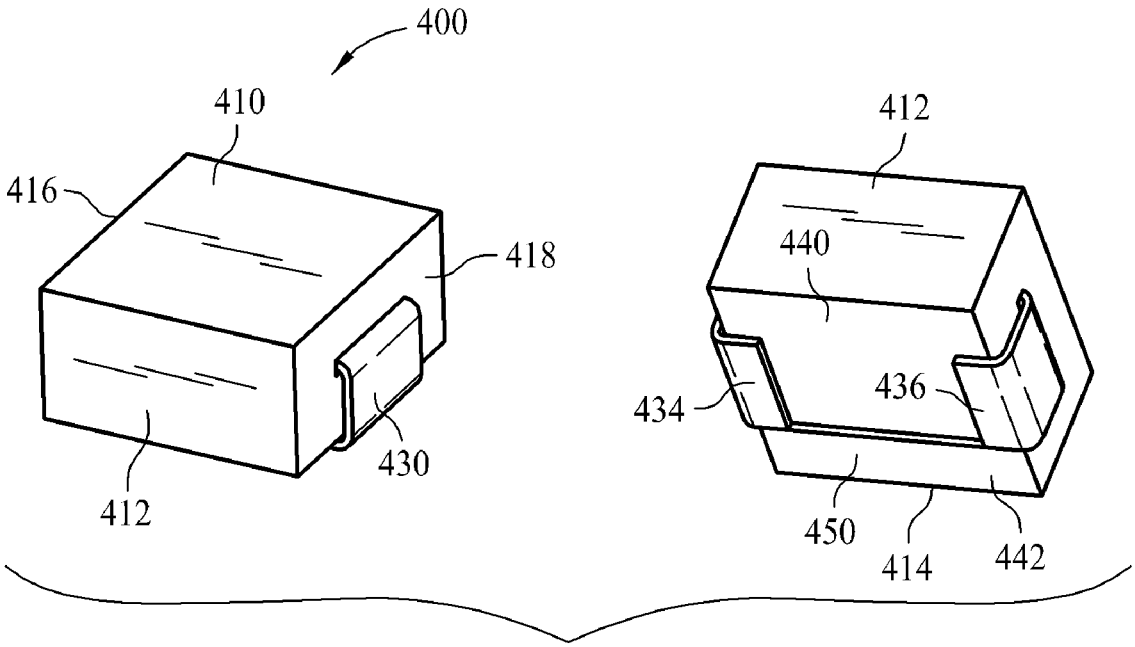
FIG. 4 illustrates a perspective view of a power inductor having a bead core in accordance with an exemplary embodiment.

FIG. 4 illustrates a perspective view of a power inductor having a bead core in accordance with an exemplary embodiment. In this embodiment, the power inductor 400 comprises a bead core 410 and a semi-preformed clip 430. As used herein and throughout the specification, the bead core 410 has two sides 412, 414 and two ends 416, 418, wherein the two sides 412, 414 are parallel with respect to the winding, or clip, 430 and the two ends 416, 418 are perpendicular with respect to the winding, or clip 430.

In an exemplary embodiment, the bead core 410 is fabricated from an amorphous powder core material, which is the same material as described above in reference to the ER core 110 and the I core 150. According to some embodiments, the amorphous powder core material can be an iron-based amorphous powder core material. Additionally, a nanoamorphous powder material may also be used for these core materials.

The semi-preformed clip 430 comprises two terminals, or leads, 434, 436 at opposing two ends 416, 418 and may be coupled to the bead core 410 by having a portion of the semi-preformed clip 430 pass centrally within the bead core 410 and having the two terminals 434, 436 wrap around the two ends 416, 418 of the bead core 410. The semi-preformed clip 430 can allow better DCR control, when compared to a non-preformed clip, because bending and cracking of platings is greatly reduced in the manufacturing process.

The semi-preformed clip 430 is fabricated from copper and is plated with nickel and tin. Although the semi-preformed clip 430 is made from copper and has nickel and tin plating, other suitable conductive materials, including but not limited to gold plating and soldering, may be utilized in fabricating the semi-preformed clip 430 without departing from the scope and spirit of the invention. Additionally, although a semi-preformed clip 430 is used in this embodiment, the clip 430 may be not preformed without departing from the scope and spirit of the invention. Furthermore, although a semi-preformed clip 430 is depicted in this embodiment, any form of winding may be used without departing from the scope and spirit of the invention.

As illustrated in FIG. 4, the semi-preformed clip 430 is coupled to the bead core 410 by having a portion of the semi-preformed clip 430 pass within the bead core 410 and having the two terminals 434, 436 wrap around the two ends 416, 418 of the bead core 410. In some embodiments, the bead core 410 can be modified to have a removed portion 440 from one side 412 of the bottom 450 of the bead core 410 and a non-removed portion 442 from the opposing side 414 of the bead core 410. The two terminals 434, 436 of the semi-preformed clip 430 can be positioned at the bottom 450 of the bead core 410 such that the terminals 434, 436 are located within the removed portion 442. Although the bead core has been illustrated having a removed portion and a non-removed portion, the bead core may be formed to omit the removed portion without departing from the scope and spirit of the invention.

According to an exemplary embodiment, the amorphous powder core material may be initially formed into a sheet and then wrapped or rolled around the semi-preformed clip 430. Upon rolling the amorphous powder core material around the semi-preformed clip 430, the amorphous powder core material and the semi-preformed clip 430 can then be pressed at high pressures, thereby forming the power inductor 400. The press molding removes the physical gap that is generally located between the semi-preformed clip 430 and the bead core 410 by having the bead core 410 form molded around the semi-preformed clip 430.

According to another exemplary embodiment, the amorphous powder core material and the semi-preformed clip 430 may be positioned within a mold (not shown), such that the amorphous powder core material surrounds at least a portion of the semi-preformed clip 430. The amorphous powder core material and the semi-preformed clip 430 can then be pressed at high pressures, thereby forming the power inductor 400. The press molding removes the physical gap that is generally located between the semi-preformed clip 430 and the bead core 410 by having the bead core 410 form molded around the semi-preformed clip 430.

Additionally, other methods may be used to form the inductor described above. In a first alternative method, a bead core may be formed by pressing the amorphous powder core material at high pressures, followed by coupling the winding to the bead core, and then followed by adding additional amorphous powder core material to the bead core so that the winding is disposed between the bead core and at least a portion of the additional amorphous powder core material. The bead core, the winding and the additional amorphous powder core material are then pressed together at high pressures to form the power inductor described in this embodiment. In a second alternative method, two discrete shaped cores may be formed by pressing the amorphous powder core material at high pressures, followed by positioning the winding between the two discrete shaped cores, and then followed by adding additional amorphous powder core material. The two discrete shaped cores, the winding, and the additional amorphous powder core material are then pressed together at high pressures to form the power inductor described in this embodiment. In a third alternative method, injection molding can be used to mold the amorphous powder core material and the winding together. Although a bead core is described in this embodiment, other shaped cores may be utilized without departing from the scope and spirit of the exemplary embodiment.

Figure 5:
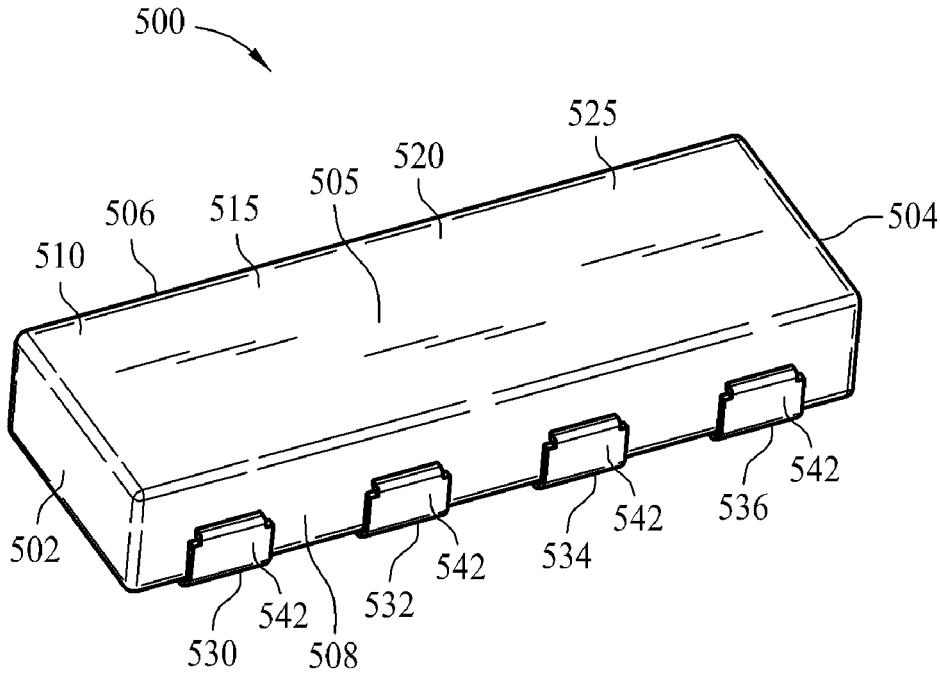
FIG. 5 illustrates a perspective view of a power inductor having a plurality of U shaped-cores formed as a single structure in accordance with an exemplary embodiment.

FIG. 5 illustrates a perspective view of a power inductor having a plurality of U shaped-cores formed as a single structure in accordance with an exemplary embodiment. In this embodiment, the power inductor 500 comprises four U shaped-cores 510, 515, 520, 525 formed as a single structure 505 and four clips 530, 532, 534, 536, wherein each clip 530, 532, 534, 536 is coupled to a respective one of the U shaped-core 510, 515, 520, 525 and wherein each clip 530, 532, 534, 536 is not preformed. As used herein and throughout the specification, the inductor 500 has two sides 502, 504 and two ends 506, 508, wherein the two sides 502, 504 are parallel with respect to the windings, or clips, 530, 532, 534, 536, and the two ends 506, 508 are perpendicular with respect to the windings, or clips, 530, 532, 534, 536. Although four U cores

510, 515, 520, 525 and four clips 530, 532, 534, 536 are shown to form a single structure 505, greater or fewer U cores, with a corresponding number of clips, may be used to form the single structure without departing from the scope and spirit of the invention.

In an exemplary embodiment, the core material is fabricated from an iron-based amorphous powder core material, which is the same material as described above in reference to the ER core 110 and the I core 150. Additionally, a nanoamorphous powder material may also be used for these core materials.

Each clip 530, 532, 534, 536 has two terminals, or leads, 540 (not shown), 542 at opposing ends and may be coupled to each of the U shaped-cores 510, 515, 520, 525 by having a portion of the clip 530, 532, 534, 536 pass centrally within each of the U shaped-cores 510, 515, 520, 525 and having the two terminals 540 (not shown), 542 of each clip 530, 532, 534, 536 wrap around the two ends 506, 508 of the inductor 500.

The clips 530, 532, 534, 536 are fabricated from copper and are plated with nickel and tin. Although the clips 530, 532, 534, 536 are made from copper and has nickel and tin plating, other suitable conductive materials, including but not limited to gold plating and soldering, may be utilized in fabricating the clips without departing from the scope and spirit of the invention. Additionally, although the clips 530, 532, 534, 536 are depicted in this embodiment, any form of windings may be used without departing from the scope and spirit of the invention.

As illustrated in FIG. 5, the clips 530, 532, 534, 536 are coupled to the U shaped-cores 510, 515, 520, 525 by having a portion of each of the clips 530, 532, 534, 536 pass within each of the U shaped-cores 510, 515, 520, 525 and having the two terminals 540 (not shown), 542 of each preformed clip 530, 532, 534, 536 wrap around the two ends 506, 508 of the inductor 500.

According to an exemplary embodiment, the amorphous powder core material may be initially formed into a sheet and then wrapped around the clips 530, 532, 534, 536. Upon wrapping the amorphous powder core material around the clips 530, 532, 534, 536, the amorphous powder core material and the clips 530, 532, 534, 536 can then be pressed at high pressures, thereby forming the U-shaped inductor 500 having a plurality of U shaped-cores 510, 515, 520, 525 formed as a single structure 505. The press molding removes the physical gap that is generally located between the clips 530, 532, 534, 536 and the cores 510, 515, 520, 525 by having the cores 510, 515, 520, 525 form molded around the clips 530, 532, 534, 536.

According to another exemplary embodiment, the amorphous powder core material and the clips 530, 532, 534, 536 may be positioned within a mold (not shown), such that the amorphous powder core material surrounds at least a portion of the clips 530, 532, 534, 536. The amorphous powder core material and the clips 530, 532, 534, 536 can then be pressed at high pressures, thereby forming the U-shaped inductor 500 having a plurality of U shaped-cores 510, 515, 520, 525 formed as a single structure 505. The press molding removes the physical gap that is generally located between the clips 530, 532, 534, 536 and the cores 510, 515, 520, 525 by having the cores 510, 515, 520, 525 form molded around the clips 530, 532, 534, 536.

Additionally, other methods may be used to form the inductor described above. In a first alternative method, a plurality of U-shaped cores may be formed together by pressing the amorphous powder core material at high pressures, followed by coupling the plurality of windings to each of the plurality of U-shaped cores, and then followed by adding additional amorphous powder core material to the plurality of U-shaped cores so that the plurality of windings are disposed between the plurality of U-shaped cores and at least a portion of the additional amorphous powder core material. The plurality of U-shaped cores, the plurality of windings, and the additional amorphous powder core material are then pressed together at high pressures to form the inductor described in this embodiment. In a second alternative method, two discrete shaped cores, wherein each discrete shaped core has a plurality of shaped cores coupled together, may be formed by pressing the amorphous powder core material at high pressures, followed by positioning the plurality of windings between the two discrete shaped cores, and then followed by adding additional amorphous powder core material. The two discrete shaped cores, the plurality of windings, and the additional amorphous powder core material are then pressed together at high pressures to form the inductor described in this embodiment. In a third alternative method, injection molding can be used to mold the amorphous powder core material and the plurality of windings together. Although a plurality of U-shaped cores are described in this embodiment, other shaped cores may be utilized without departing from the scope and spirit of the exemplary embodiment.

Additionally, the plurality of clips 530, 532, 534, 536 may be connected in parallel to each other or in series based upon circuit connections on a substrate (not shown) and depending upon application requirements. Furthermore, these clips 530, 532, 534, 536 may be designed to accommodate multi-phase current, for example, three-phase and four-phase.

Although several embodiments have been disclosed above, it is contemplated that the invention includes modifications made to one embodiment based upon the teachings of the remaining embodiments.

While single piece core constructions fabricated from distributed gap magnetic materials and one or more coils arranged in the single piece core construction is advantageous in certain applications, in other applications still other benefits may be realized using discrete core pieces assembled with one or more coils and incorporating physical gaps can provide desirable performance advantages. Structures and methods of accomplishing assembly of discrete core pieces and physical gaps are described further below.

Figure 6:
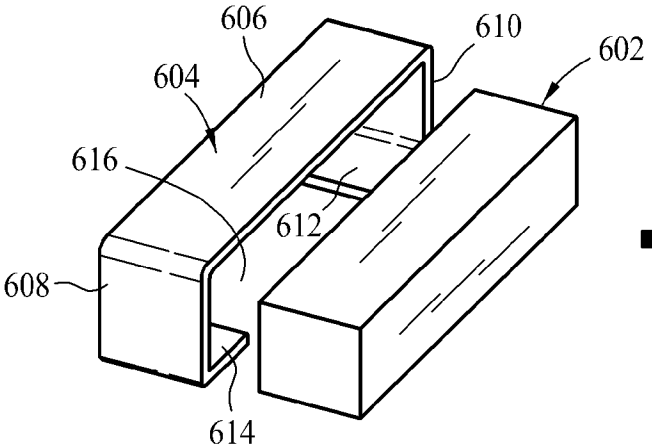

FIGS. 6-9 illustrate another magnetic component assembly 600 at various stages of manufacture. As shown in FIG. 6, the assembly includes a first magnetic core piece 602 and winding 604 forming a first subassembly.

In the exemplary embodiment shown, the magnetic core piece 602 is an I Core having an elongated rectangular block or brick shape. The magnetic core piece 602 may be fabricated from any of the magnetic materials described above and associated techniques, or alternatively may be fabricated from other suitable materials and techniques known in the art.

Also in the exemplary embodiment shown, the winding 604 is provided in the form of a pre-formed winding clip having an elongated, generally flat and planar main winding section 606 and opposing leg sections 608 and 610 extending from either end of the main winding section 606. The legs 608 and 610 extend generally perpendicularly from the plane of the main winding section 604 in a substantially C-shaped arrangement. The pre-formed winding clip 604 further includes terminal lead sections 612, 614 extending from each of the respective legs 608 and 610. The terminal lead sections 612, 614 extend generally perpendicular to the respective planes of the legs 608 and 610 and generally parallel to a plane of the main winding section 606. The terminal lead sections 612, 614 provide spaced apart contact pads for surface mounting to a circuit board (not shown). The clip 604 and its sections 606, 608, 610, 612 and 614 collectively form a body or frame defining an interior region or cavity 616. In the exemplary embodiment shown, the cavity 616 is substantially rectangular and complementary in shape to the first magnetic core piece 602.

In exemplary embodiments, the clip 604 may be fabricated from a sheet of copper or other conductive material or alloy and may and formed into the shape as shown using known techniques, including but not limited to stamping and pressing techniques. In an exemplary embodiment, the clip 604 is separately fabricated and provided for assembly to the core piece 602, referred to here as being a pre-formed coil 610. Such a pre-formed coil 604 is specifically contrasted with conventional magnetic component assemblies wherein the coil is formed about a core piece, or otherwise is bent or shaped around a core piece.

Figure 7:
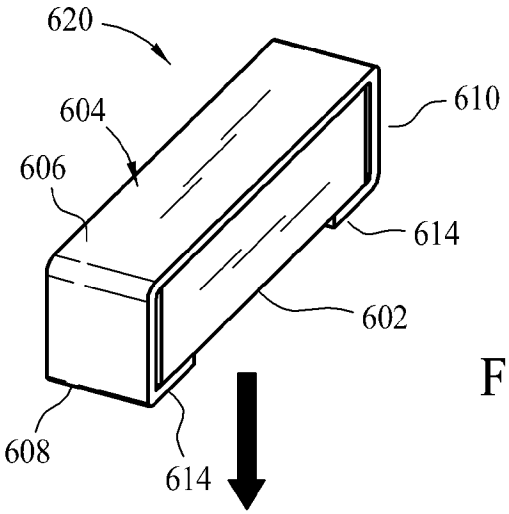

As shown in FIG. 7 the clip 604 and the first magnetic core piece 602 are assembled or otherwise coupled to one another to form a first subassembly 620. In one embodiment the core piece 602 could be fabricated independently from the clip 604 and the core piece 602 is fitted into the cavity 616 of the clip 604 to complete the subassembly with, for example, sliding engagement. In another embodiment, the core piece 602 could be formed in the cavity 616 using a pressing or molding process, for example. However formed, in the exemplary embodiment shown, the core piece 602 is sized and shaped to be substantially coextensive with the cavity 616 of the clip 604. That is, the core piece 602 substantially fills the cavity 616, but does not project from the cavity 616 of the clip 604. In other words, the magnetic core piece 602 is generally self-contained in the interior confines of the clip, and the external dimensions of the core and clip assembly shown in FIG. 7 is equal to the external dimensions of the clip 604 itself before assembly with the core piece 602.

As FIG. 7 illustrates, each section 606, 608, 610, 612, 614 of the clip 604 physically abuts or engages a different side surface or face of the magnetic core piece 602. The core piece 602 is securely received and cradled within the clip 604 such that the subassembly 620 may be moved as a unit in further assembly steps of magnetic components.

Figure 8:
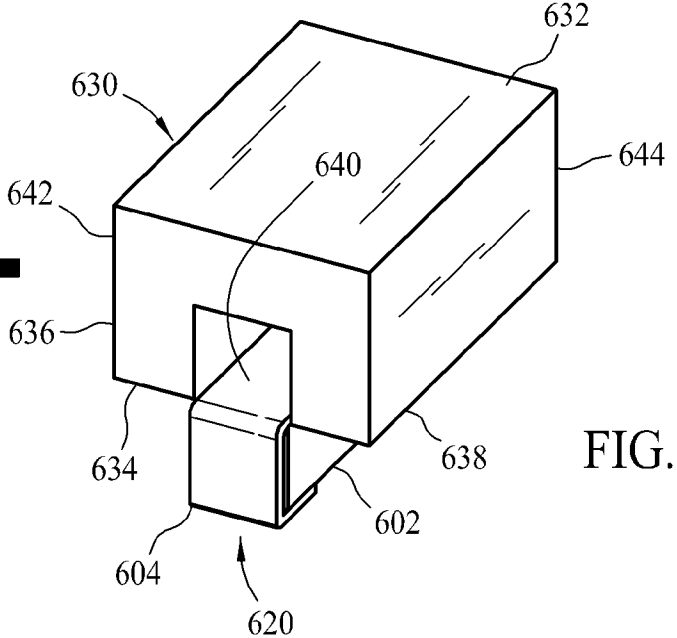

FIG. 8 illustrates the subassembly 620 of FIG. 7 being assembled with a second magnetic core piece 630. The second magnetic core piece 630 may be fabricated from any of the magnetic materials described above and associated techniques, or alternatively may be fabricated from other suitable materials and techniques known in the art. Furthermore, the second magnetic core piece 630 in various embodiments may be fabricated from the same or different magnetic material than used to fabricate the first core piece 602. That is, if desired, the first and second magnetic core pieces 602, 630 may exhibit different magnetic materials or the same magnetic materials depending on the particular materials chosen.

In the exemplary embodiment shown, the second magnetic core piece 630 is a U core having a U shape including a substantially planar surface 632 and a surface 634 opposing the planar surface 632 that includes a first leg 636, a second leg 638, and a clip channel 640 defined between the first and second legs 636 and 638. In different embodiments, symmetrical and asymmetrical U-cores may be utilized as described above. The subassembly 620 including the first core piece 602 and the clip 604 is aligned with and inserted in the clip channel 640 as shown in FIG. 8 such that the subassembly 620 is inter-fitted with the core piece 630. As such, the subassembly 620 extends axially through the second core piece 630 for substantially an entire axial distance between opposing ends 642, 644 of the second core piece 630. That is, the leg sections 608, 610 (FIG. 6) of the clip lie generally adjacent and substantially flush or coplanar with the ends 642, 644 of the second core piece 630. When so assembled, the first and second core pieces 602, 630 may be bonded together with adhesives and the like.

Figure 9:
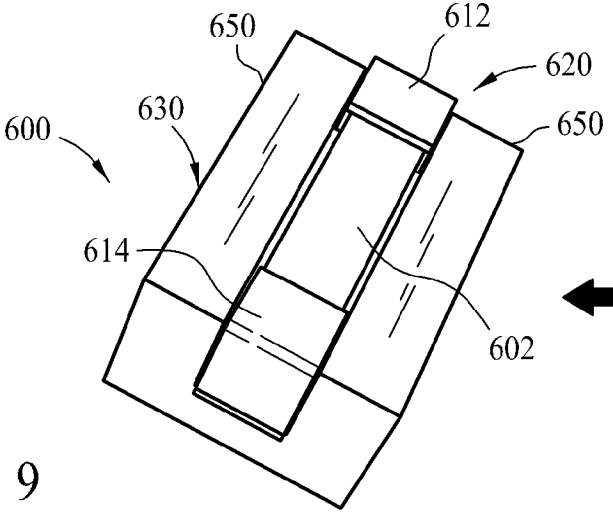

As shown in the completed component 600 in FIG. 9, the terminal lead sections 612, 614 are exposed and substantially flush or coplanar with the bottom surface of the second core piece 630 and hence are well situated for surface mount, electrical connection to a circuit board. Additionally, and as shown in FIG. 9, physical gaps 650 may be formed between the core pieces 602 and 630 and may provide desirable performance characteristics for a power inductor, and potentially for other types of magnetic components in other embodiments. In the embodiment shown, the gaps 650 extend axially on either side of the subassembly 620 within the clip channel 640 (FIG. 8) in the second magnetic core piece 630. The size of the gaps 650 may be varied by adjusting the dimensions of the clip channel 640 (FIG. 8) in the second core piece 630 and/or the dimension of the subassembly 620 that includes the first core piece 602. By varying the dimensions of the gaps, the performance characteristics of the resultant magnetic component may be varied to meet particular objectives and provide a variety of power inductors, for example, having different performance characteristics in a uniform package size and with relatively easy and efficient manufacturing step compared to conventional magnetic components.

While a single coil embodiment has been described in relation to FIGS. 6-9, it is recognized that multiple coil embodiments are possible in further and/or alternative embodiments.

FIGS. 10-13 illustrate another magnetic component assembly 700 at various stags of manufacture.

Figure 10:
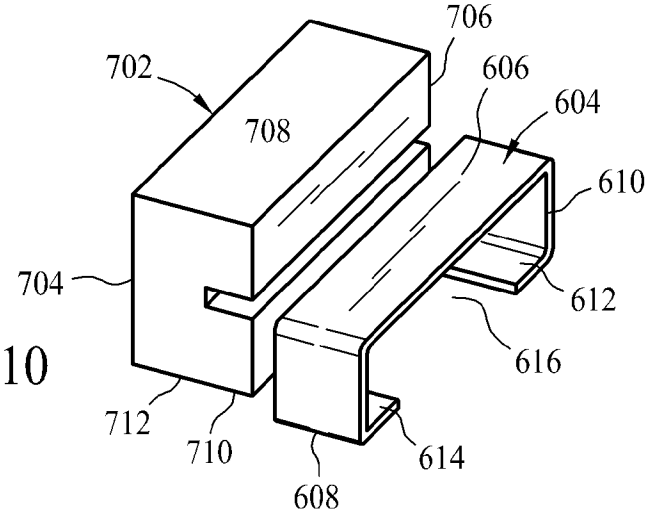

As shown in FIG. 10, the assembly includes a first magnetic core piece 702 and the pre-formed winding clip 604 forming a first subassembly. In the embodiment shown, the first core piece 702 is a U core having a U shape including a substantially planar surface 704 and a surface 706 opposing the planar surface 704 that includes a first leg 708, a second leg 710, and a clip channel 712 defined between the first and second legs 708 and 710. The first magnetic core piece 702 may be fabricated from any of the magnetic materials described above and associated techniques, or alternatively may be fabricated from other suitable materials and techniques known in the art. In different embodiments, symmetrical and asymmetrical U-cores may be utilized as described above.

Figure 11:
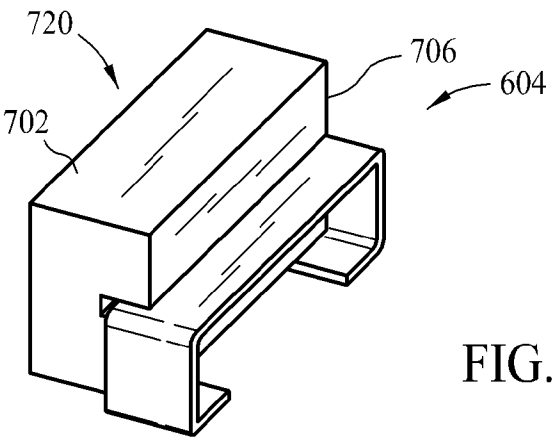

As shown in FIG. 11, when the clip 604 is coupled to the core piece a subassembly 720 is formed. The main winding section 606 of the clip 604 is slidably received in the clip channel 712 and the remaining sections 608, 610, 612, 614 of the clip 604 wrap around the outer perimeter of the leg 710 of the first core piece 700. That is, the leg 710 of the first core piece 702 is received in the interior cavity 616 of the clip 604. Each section 606, 608, 610, 612, 614 of the clip 604 physically abuts or engages a different side surface or face of the leg 710 of the core piece 602. The leg 710 is securely received and cradled within the clip 604 such that the subassembly 720 may be moved as a unit in further assembly steps of magnetic components.

In the exemplary embodiment shown, the clip 604 is only partially received in the clip channel 712 such that the clip 604 projects from the surface 706 of the core piece 702 in the subassembly 720. Specifically, the winding section 606 of the clip 604 is engaged with the clip channel 712 with the remaining 608, 610, 612, 614 of the clip 604 physically abutting or engaging a different side surface or face of the leg 710 of the core piece 702. The terminal lead sections 612, 614 extend substantially parallel to the clip channel 712 and are exposed on the bottom surface of the core leg 710 for surface mount connection to a circuit board.

The leg 710 of the core piece 702 is securely received and cradled within the clip 604 such that the subassembly 720 may be moved as a unit in further assembly steps of magnetic components.

Figure 12:
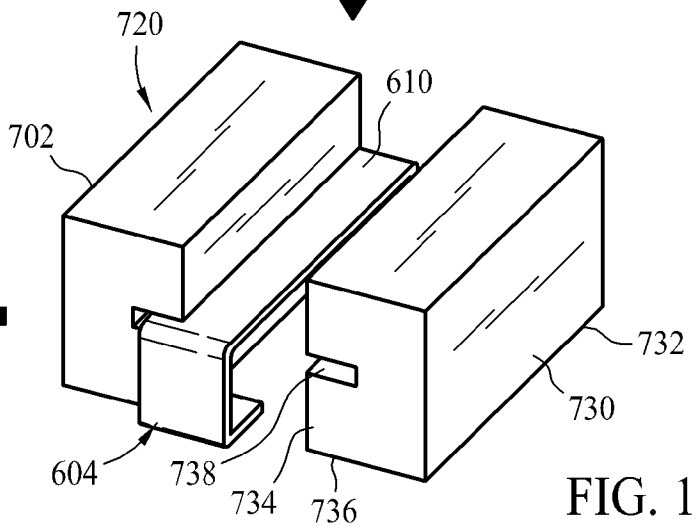

As shown in FIG. 12, the subassembly 720 is inter-fitted with a second magnetic core piece 730. The second core piece 730 is a U core having a U shape including a substantially planar surface 732 and a surface 734 opposing the planar surface 732 that includes a first leg 734, a second leg 736, and a clip channel 738 defined between the first and second legs 734 and 736. The second magnetic core piece 730 may be fabricated from any of the magnetic materials described above and associated techniques, or alternatively may be fabricated from other suitable materials and techniques known in the art. The second core piece 730 may likewise be fabricated from the same or different material as the first magnetic core piece 702. In different embodiments, symmetrical and asymmetrical U-cores may be utilized as described above.

The second core piece 730 in the example shown is substantially identically sized and shaped as the core piece 702, but is arranged in an opposing, mirror image orientation to the first core piece 702. The clip channel 738 of the second core piece 730 receives an exposed portion of the clip 604 such that the clip surrounds an outer perimeter of the leg 736 of the second core piece 730. As such, the main winding section 610 of the clip 604 is received partly in the clip channel 712 of the first core piece 702 and is received partly in the clip channel 738 of the second core piece 730. The remaining sections 608, 610, 612, 614 of the clip 604 partly enclose a portion of the leg 710 of the first core piece 702 and partly enclose a portion of the leg 736 of the second core piece 730. When so assembled, the first and second core pieces 702, 730 may be bonded together with adhesives and the like.

Figure 13:
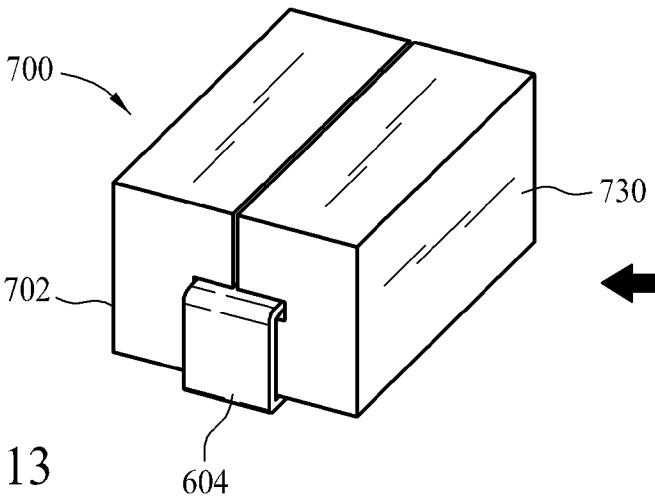

As shown in FIG. 13, in the completed component 700 physical gaps 752 may be formed between the core pieces 702 and 730 and may provide desirable performance characteristics for a power inductor, and potentially for other types of magnetic components in other embodiments. In the embodiment shown, the gaps 752 extend between the opposing core pieces 702 and 730 in a plane perpendicular to the main winding section 610 (FIG. 10) of the clip 604 and substantially bisect the main winding portion 610 (FIG. 10) of the clip 604. The size of the gaps 752 may be varied by adjusting the dimensions of the clip channels 712 (FIG. 10) and 738 (FIG. 12) in the first and second core pieces 702 and 730 and/or the lateral dimension of clip 604 extending between the opposed core pieces 702, 730. By varying the dimensions of the gaps, the performance characteristics of the resultant magnetic component may be varied to meet particular objectives and provide a variety of power inductors, for example, having different performance characteristics in a uniform package size and with relatively easy and efficient manufacturing step compared to conventional magnetic components.

While a single coil embodiment has been described in relation to FIGS. 10-13, it is recognized that multiple coil embodiments are possible in further and/or alternative embodiments.

FIGS. 14-17 illustrate another magnetic component assembly 800 at various stages of manufacture.

Figure 14:
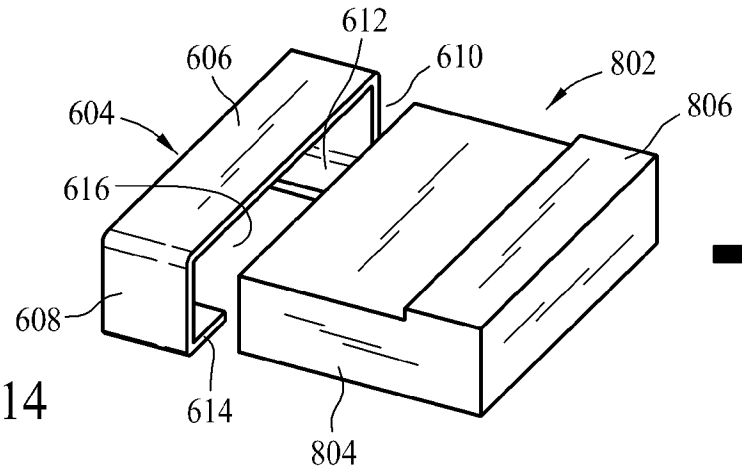

As shown in FIG. 14, the assembly includes a first magnetic core piece 802 and the pre-formed winding clip 604 forming a first subassembly. In the embodiment shown, the first core piece 802 is an L-shaped core including a first elongated leg 804 and a second truncated leg 806 extending at approximate a right angle (90°) from the first leg 804. The second leg 806 defines a raised stop face or stop surface 808 for mistake proof engagement with the clip 604 as described above. The first magnetic core piece 802 may be fabricated from any of the magnetic materials described above and associated techniques, or alternatively may be fabricated from other suitable materials and techniques known in the art.

Figure 15:
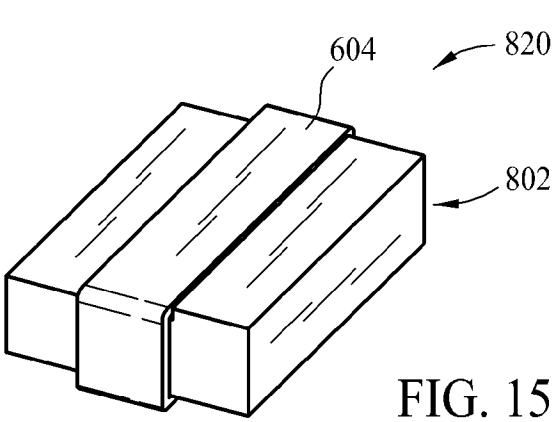

As shown in FIG. 15, when the clip 604 is coupled to the core piece 802 a subassembly 820 is formed. The first leg 804 of the first core piece 802 is received in the interior cavity 616 of the clip 604 and the clip is slidingly brought into engagement with the stop surface 808 to ensure correct positioning of the coil 604. Each section 606, 608, 610, 612, 614 of the clip 604 physically abuts or engages a different side surface or face of the leg 804 of the core piece 802. The leg 804 is securely received and cradled within the clip 604 such that the subassembly 820 may be moved as a unit in further assembly steps of magnetic components.

Figure 16:
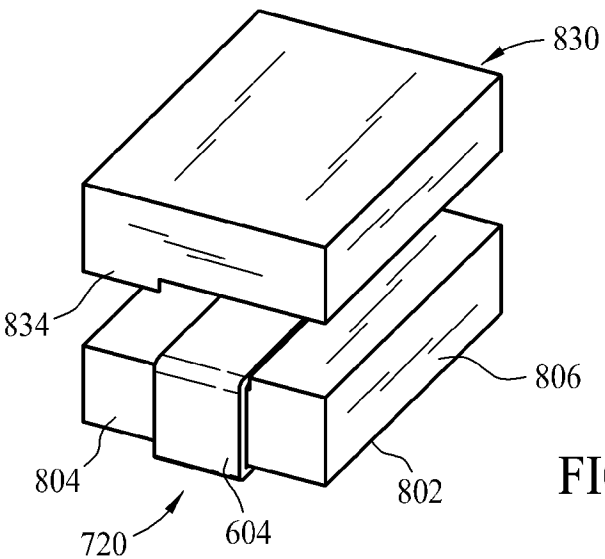

As shown in FIG. 16, the subassembly 820 is inter-fitted with a second magnetic core piece 830 overlying the subassembly 820. The second core piece 830 is an L-shaped core including a first elongated leg 832 and a second truncated leg 834 extending at approximate a right angle (90°) from the first leg 832. The second magnetic core piece 830 may be fabricated from any of the magnetic materials described above and associated techniques, or alternatively may be fabricated from other suitable materials and techniques known in the art. The second core piece 830 may likewise be fabricated from the same or different material as the first magnetic core piece 802.

The second core piece 830 in the example shown is substantially identically sized and shaped as the core piece 802, but is reversed 180° and arranged in an opposing orientation to the first core piece 802. The coil 604 is effectively captured between the opposed truncated legs 806, 834 of the respective core pieces 802 and 830, and the main winding section 610 (FIG. 14) of the coil 604 is sandwiched between the elongated legs 804, 832 of the respective core pieces 802 and 830. When so assembled, the first and second core pieces 802, 830 may be bonded together with adhesives and the like.

Figure 17:
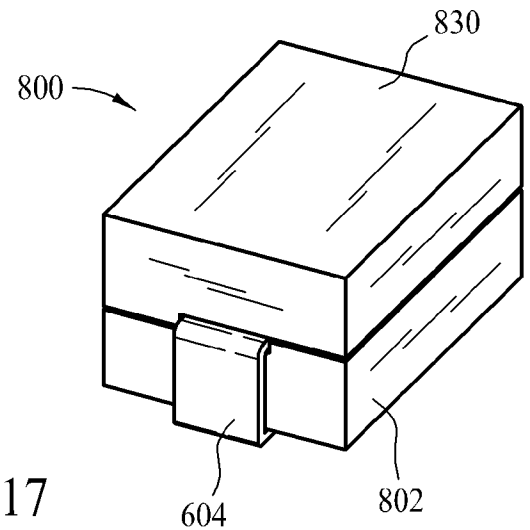

As shown in FIG. 17, in the completed component 800 a physical gap 852 may be formed between the main winding section 606 of the clip 604 and the second core piece 830 and/or other portions of the opposed core pieces 800 and 830. The gaps 852 may provide desirable performance characteristics for a power inductor, and potentially for other types of magnetic components in other embodiments. In the embodiment shown, the gap 852 extends in a plane substantially parallel to the main winding portion 610 (FIG. 10) of the leg 834 of the second core piece 830. The size of the gaps 852 may be varied by adjusting the dimensions of the leg 834 of the second core piece 830 the and/or the dimension of the clip 604. By varying the dimension of the gap, the performance characteristics of the resultant magnetic component may be varied to meet particular objectives and provide a variety of power inductors, for example, having different performance characteristics in a uniform package size and with relatively easy and efficient manufacturing step compared to conventional magnetic components.

While a single coil embodiment has been described in relation to FIGS. 14-17, it is recognized that multiple coil embodiments are possible in further and/or alternative embodiments.

FIGS. 18-21 illustrate another magnetic component assembly 900 at various stages of manufacture.

Figure 18:
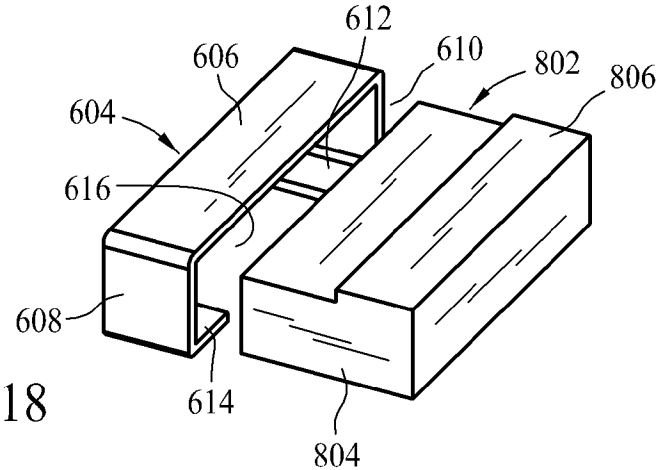

As shown in FIG. 18, the assembly includes a first magnetic core piece 802 and the pre-formed winding clip 604 forming a first subassembly. In the embodiment shown, the first core piece 802 is an L-shaped core including a first elongated leg 804 and a second truncated leg 806 extending at approximate a right angle (90°) from the first leg 804. The second leg 806 defines a raised stop face or stop surface 808 for mistake proof engagement with the clip 604 as described above. The first magnetic core piece 802 may be fabricated from any of the magnetic materials described above and associated techniques, or alternatively may be fabricated from other suitable materials and techniques known in the art.

Figure 19:
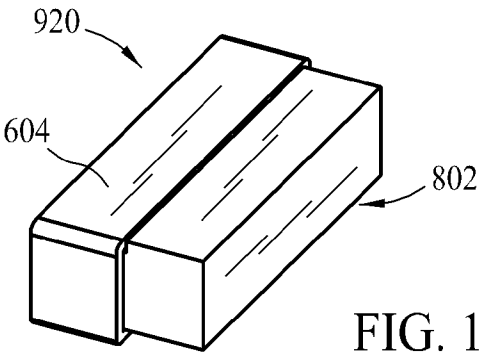

As shown in FIG. 19, when the clip 604 is coupled to the core piece 802 a subassembly 920 is formed. The first leg 804 of the first core piece 802 is completely received in the interior cavity 616 of the clip 604 and the clip is brought into sliding engagement with the stop surface 808 to ensure correct positioning of the coil 604. In contrast to the assembly 820 shown in FIG. 15, no portion of the leg 804 extends or projects beyond the clip in a direction opposing the stop surface 808. Each section 606, 608, 610, 612, 614 of the clip 604 physically abuts or engages a different side surface or face of the leg 804 of the core piece 802. The leg 804 is securely received and cradled within the clip 604 such that the subassembly 820 may be moved as a unit in further assembly steps of magnetic components.

Figure 20:
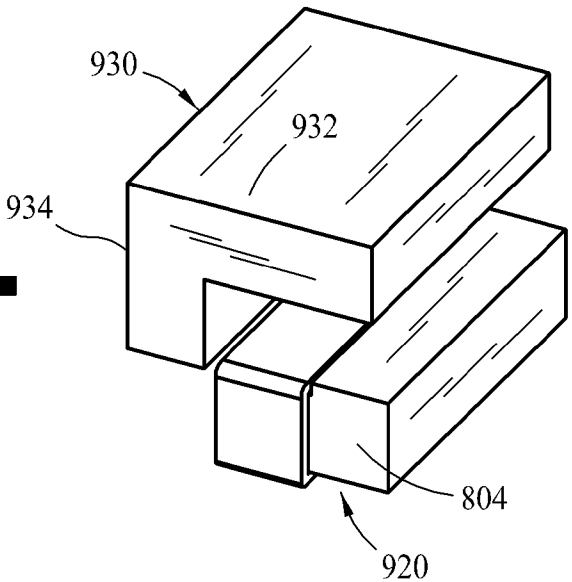

As shown in FIG. 20, the subassembly 920 is inter-fitted with a second magnetic core piece 930 overlying the subassembly 920. The second core piece 930 is an L-shaped core including a first elongated leg 932 and a second truncated leg 934 extending at approximate a right angle (90°) from the first leg 932. The second magnetic core piece 930 may be fabricated from any of the magnetic materials described above and associated techniques, or alternatively may be fabricated from other suitable materials and techniques known in the art. The second core piece 930 may likewise be fabricated from the same or different material as the first magnetic core piece 902.

The second core piece 930 in the example shown is similarly shaped (i.e., L shaped) to the core piece 802, but differently dimensioned and proportioned. The lateral sides of the coil 604 are effectively captured between the opposed truncated legs 806, 934 of the respective core pieces 802 and 930, and the main winding section 610 (FIG. 18) of the coil 604 is sandwiched between the elongated legs 804, 932 of the respective core pieces 802 and 930. When so assembled, the first and second core pieces 802, 930 may be bonded together with adhesives and the like.

Figure 21:
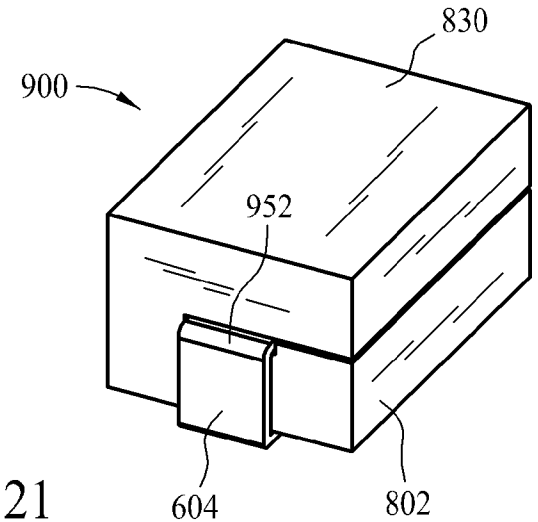

As shown in FIG. 21, in the completed component 900 a physical gap 952 may be formed between the main winding section 606 of the clip 604 and the second core piece 930 and/or other portions of the opposed core pieces 802 and 930. The gap 952 may provide desirable performance characteristics for a power inductor, and potentially for other types of magnetic components in other embodiments. In the embodiment shown, the gap 952 extends in a plane substantially parallel to the main winding portion 610 (FIG. 10) of the leg 834 of the second core piece 830. The size of the gap 952 may be varied by adjusting the dimensions of the legs 806 and 934 of the core pieces 802 and 930 the and/or the dimension of the clip 604. By varying the dimension of the gap, the performance characteristics of the resultant magnetic component may be varied to meet particular objectives and provide a variety of power inductors, for example, having different performance characteristics in a uniform package size and with relatively easy and efficient manufacturing step compared to conventional magnetic components.

While a single coil embodiment has been described in relation to FIGS. 18-21, it is recognized that multiple coil embodiments are possible in further and/or alternative embodiments.

FIG. 22 illustrates another magnetic component assembly 1000 in various stages of manufacture. As shown in FIG. 21A, a first magnetic body 1002 is formed, which may be a single piece construction or multiple piece construction in accordance with any of the embodiments described. In the sectional view shown in FIG. 21, a main winding section 1004 of a pre-formed clip passes through the magnetic body 1002 in an axial direction.

As shown in FIG. 21B, a second magnetic body 1006 is formed, which may be a single piece construction or multiple piece construction in accordance with any of the embodiments described. The second magnetic body 1006, however, is fabricated from a different magnetic material and hence has different magnetic properties than the first magnetic body 1002. In the sectional view shown in FIG. 21, the main winding section 1004 of the pre-formed clip passes through the magnetic body 1002 in an axial direction.

As shown in FIG. 21C, the first and second magnetic bodies 1002 and 1006 are arranged alongside one another and coupled to one another. The axial length of the coupled bodies 1002 and 1006 is the sum of the respective lengths of the bodies 1002 and 1006 individually. The main winding section 1004 extends across the axial length of the bodies 1002 and 1006 such that a portion of the main winding section 1004 is in contact with the magnetic material of the first body 1002 and another portion of the main winding section 1004 is in contact with the magnetic material of the second body 1002. Different flux paths and performance characteristics are therefore made possible in the different bodies 1002 and 1006, with portions of the same coil section 1004 receiving the benefit of each of the different magnetic materials utilized. Additionally, one or more physical gaps may be provided in some or all of the magnetic bodies 1002 and 1006 to provide still further performance variations and attributes. Varying inductance values and widely varying performance attributes of inductors may be achieved in such a manner by strategically selecting and jointing n number of magnetic bodies, whether physically gapped or not, and assembling with them with one or more coils.

Figure 23:
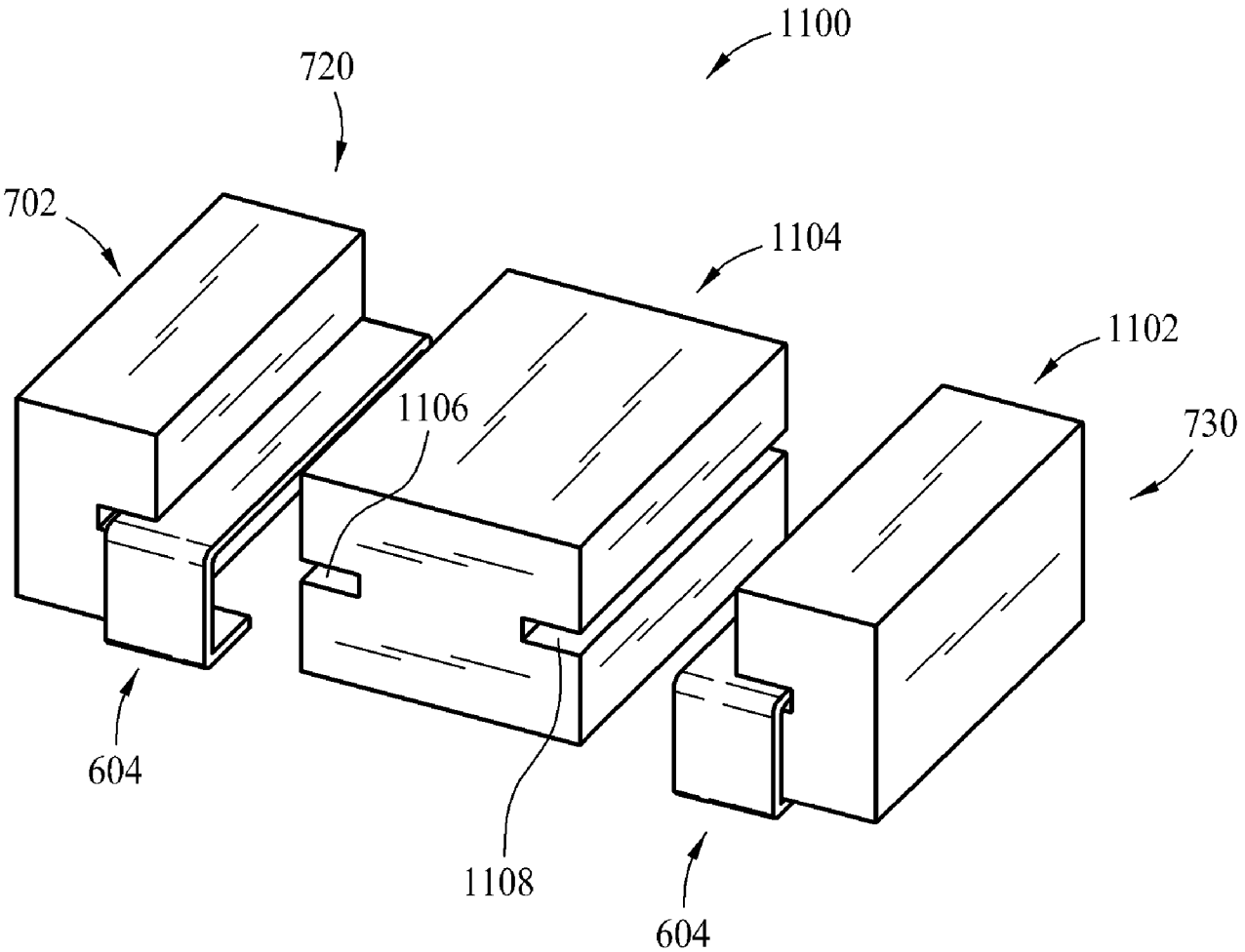
FIG. 23 illustrates an exploded view of another magnetic component assembly.
Figure 24:
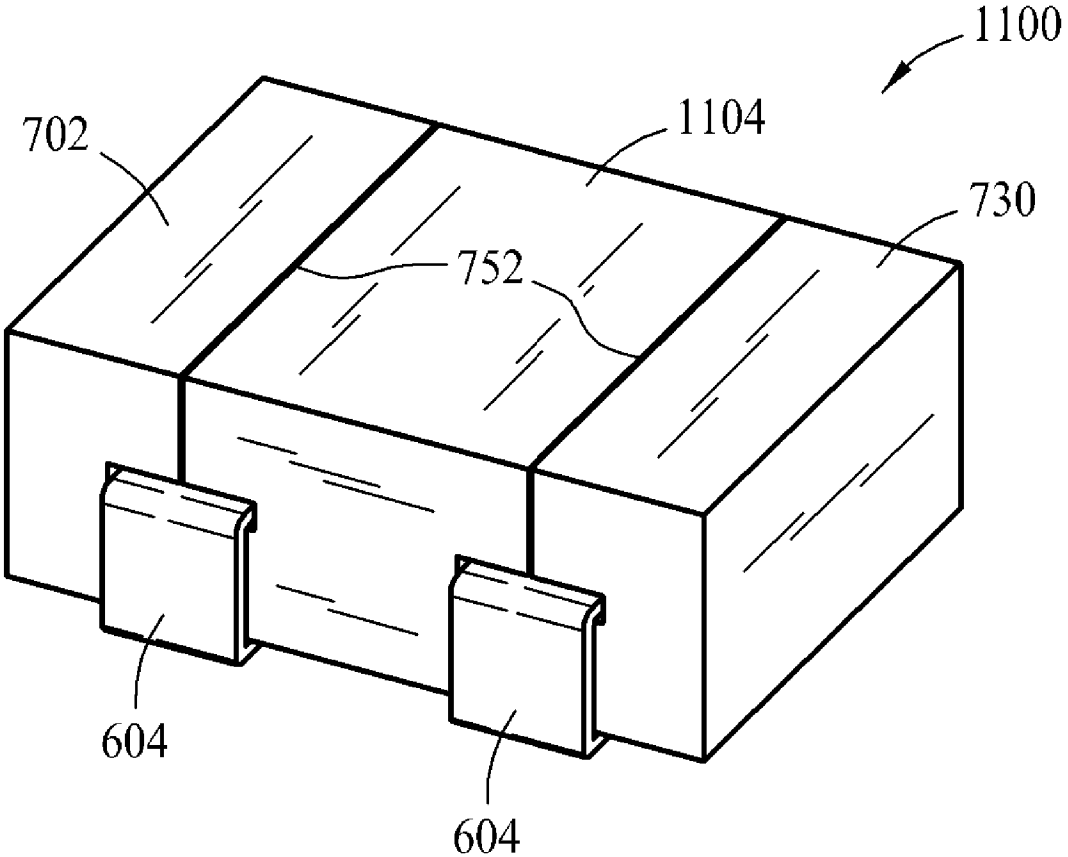
FIG. 24 illustrates an assembled view of the component shown in FIG. 23.

FIGS. 23 and 24 illustrate another magnetic component assembly 1100 in exploded view and assembled view, respectively.

As shown in FIG. 23, the component assembly 1100 includes the assembly includes the first magnetic core piece 702 and the pre-formed winding clip 604 forming a first subassembly 720 as described above in relation to FIG. 11. The assembly 100 further includes the second magnetic core piece 730, also fitted with a pre-formed winding clip 604 forming a second subassembly 1102. Situated between and separating the first and second subassemblies is a third magnetic core piece 1104 having a first clip channel 1106 and a second clip channel 1108 opposing the first clip channel 1106. The third magnetic core piece 1104 may be formed in the shape of an I-beam as shown in FIG. 23. Alternatively stated, the third magnetic core piece 1104 may include mutually opposed faces each having a U-shape with the clip channels 1106, 1108 extending between respective legs.

The first clip channel 1106 faces the first subsassembly 720 and accepts a portion of the clip 604 thereof. The second clip channel 1108 faces the second subassembly 1102 and accepts a portion of the clip 604 thereof. When assembled, as shown in FIG. 24, the clips 604 are spaced apart from one another by the third magnetic core piece 1104, and physical gaps 752 extend between the first and second core pieces 702 and 1104, and the third and second core pieces 1104 and 730. In the exemplary embodiments shown, the gaps 752 extend between the opposing core pieces 702 and 1104, and the core pieces 1104 and 730 in a plane perpendicular to the main winding section 610 (FIG. 10) of each clip 604 and substantially bisect the main winding portion 610 (FIG. 10) of each clip 604.

In various embodiments, the magnetic material used to fabricate the third core piece 1104 may be the same or different from the magnetic materials used to fabricate the first and second piece 702 and 730, and hence the third core piece may have the same or different magnetic properties as the core piece 702 or 730. Thus, the main winding sections 610 of the clips 604 may extend across and be in contact with different magnetic materials in such an embodiment. Different flux paths and performance characteristics are therefore made possible in the different bodies 702, 1104 and 730, with portions of the clips 604 receiving the benefit of each of the different magnetic materials utilized.

Additional magnetic pieces 1104 may be provided and utilized with additional clips 604 to extend the axial length of the assembly 100 and provide still further benefits in a relatively compact arrangement.

It is contemplated that the component assemblies 600 (FIG. 9), 800 (FIG. 17), 900 (FIG. 21) could similarly be provided with a third magnetic core piece (or additional core pieces) inter-fitted with additional clips to provide other variations of magnetic component assemblies. Such embodiments may be particularly beneficial for multi-phase power inductor components.

The advantages and benefits of the invention are now believed to be apparent from the exemplary embodiments described. It is further believed that further and alternative embodiments could be derived by those in the art having the benefit of the present disclosure while still being within the scope and spirit of the exemplary claims submitted herewith.

One exemplary embodiment of a magnetic component assembly has been disclosed that comprises: a first magnetic core piece; a first pre-formed clip coupled to said first magnetic core piece; and a second magnetic core piece fitted with the first magnetic core piece and the coupled coil.

Optionally, the first pre-formed clip may include a flat conductor formed substantially in a C-shape. The C-shape includes a first leg and a second leg, with the preformed clip further comprising terminal leads extending from each of the first and second leads. The first pre-formed clip may define a substantially rectangular interior cavity, the interior cavity being extended over the first core piece. The first core piece may be dimensioned to be substantially coextensive with the interior cavity of the first preformed clip.

The second magnetic core piece may optionally define a slot dimensioned to receive and contain the first core piece, and the first and second magnetic core pieces are physically gapped from one another. The second magnetic core piece is substantially U-shaped.

As another option, the first magnetic core piece may include a first leg, a second leg, and a clip channel defined between the first leg and the second leg, and a portion of the first pre-form clip may be received in the clip channel of the first magnetic core piece. The second magnetic core piece may likewise include a first leg, a second leg, and a clip channel defined between the first leg and the second leg, with a portion of the first pre-form clip received in the clip channel of the second magnetic core piece. The pre-formed clip may comprise a flat conductor formed substantially in a C-shape. The C-shape may include a first leg and a second leg, with preformed clip further comprising terminal leads extending from each of the first and second leads, the terminal leads extending substantially parallel to the clip channel in one of the first and second magnetic core pieces. The pre-formed clip may further define a substantially rectangular interior cavity, and the interior cavity may be extended over the first magnetic core piece and wrap around one of the first and second legs.

In another option, the first magnetic core piece may optionally be substantially L-shaped. The L-shaped magnetic core piece may include a long leg and a short leg extending substantially perpendicularly from the long leg. The pre-first formed clip may define a substantially rectangular interior cavity, with the interior cavity being extended over and wrapping around a portion of the long leg. The second magnetic core piece may also be substantially L-shaped, with the second magnetic core piece being reversed relative to the first magnetic core piece and overlying the first pre-formed coil. The first and second L-shaped magnetic cores may be substantially identically sized and shaped or differently sized and shaped.

As another option, the first and second magnetic core pieces are arranged alongside one another and are coupled to one another, with the first pre-formed coil extending across and in intimate contact with each of the plurality of magnetic core pieces. At least two of the plurality of magnetic core pieces may optionally be fabricated from different magnetic materials having different magnetic properties, including but not limited to an amorphous powder material.

A third magnetic core piece may optionally be interposed between the first and second magnetic core piece, and a second preformed clip may be provided and fitted with the second magnetic core piece and the third magnetic core piece.

An exemplary method of forming a magnetic component is also disclosed. The component includes first and second magnetic core pieces and a pre-formed winding clip. The method comprises: coupling the pre-formed winding clip to the first magnetic core piece; and assembling the coupled coil and first magnetic piece to the second magnetic piece, whereby the first and second magnetic piece collectively surround and enclose a portion of the C-shaped clip.

Optionally, the pre-formed winding clip may define an interior cavity, and coupling the pre-formed winding clip to the first magnetic core piece may comprise inserting a portion of the first magnetic core piece into the interior cavity.

Coupling the pre-formed winding clip to the first magnetic core piece may optionally further comprise sliding the pre-formed winding clip along the first magnetic core piece until the pre-formed winding clip abuts a stop surface.

The pre-formed winding clip may optionally be substantially C-shaped, and one of the first and second magnetic core may optionally be U-shaped.

As another option, both of the first and second magnetic core pieces may be U-shaped, with each of the U-shaped core pieces receives a portion of the C-shaped winding clip.

In still another option, the pre-formed winding clip may be substantially C-shaped, and one of the first and second magnetic core pieces may be L-shaped. Further, both of the first and second magnetic core pieces may optionally be L-shaped, and the L-shaped core pieces may be reversed relative to one another.

Although the invention has been described with reference to specific embodiments, these descriptions are not meant to be construed in a limiting sense. Various modifications of the disclosed embodiments, as well as alternative embodiments of the invention, will become apparent to persons having ordinary skill in the art upon reference to the description of the invention. It should be appreciated by those having ordinary skill in the art that the conception and the specific embodiments disclosed may be readily utilized as a basis for modifying or designing other structures for carrying out the same purposes of the invention. It should also be realized by those having ordinary skill in the art that such equivalent constructions do not depart from the spirit and scope of the invention as set forth in the appended claims. It is therefore contemplated that the claims will cover any such modifications or embodiments that fall within the scope of the invention.

What is claimed is:

1. A magnetic component assembly comprising:

a first magnetic core piece;

a first pre-formed winding clip separately fabricated from the first magnetic core piece, the first pre-formed winding clip including terminal lead sections configured for surface mounting of the assembly, the first pre-formed clip assembled to said first magnetic core piece without shaping any portion of the winding clip about the first magnetic core piece a second magnetic core piece fitted with the first magnetic core piece and the assembled pre-formed winding clip;

wherein the first pre-formed winding clip comprises a flat conductor formed substantially in a C-shape having a planar main winding section extending in a first plane, opposing first and second legs extending substantially perpendicular to the first plane, and first and second terminal lead sections respectively extending from each of the first and second legs, the first and second terminal lead sections extending in a plane spaced from but parallel to the first plane and the first and second terminal lead sections extending inwardly toward one another;

a third magnetic core piece interposed between the first and second magnetic core piece; and a second preformed clip fitted with the second magnetic core piece and the third magnetic core piece;

wherein the third magnetic core piece includes a first clip channel and a second clip channel;

wherein the third magnetic piece includes a first side and a second side opposing the first side; and wherein the first clip channel extends on the first side and the second clip channel extends on the second side.

2. The magnetic component assembly of claim 1, wherein the first pre-formed winding clip defines a substantially rectangular interior cavity, the interior cavity being extended over the first core piece.

3. The magnetic component assembly of claim 1:

wherein the first magnetic core piece includes a first leg, a second leg, and a third clip channel defined between the first leg and the second leg; and wherein a first portion of the main winding section of the first pre-formed winding clip is received in the third clip channel of the first magnetic core piece.

4. The magnetic component assembly of claim 3, wherein the first pre-formed winding clip defines a substantially rectangular interior cavity, the interior cavity being extended over the first magnetic core piece and wrapping around one of the first and second legs.

5. The magnetic component assembly of claim 1, wherein at least two of the first, second, and third magnetic core pieces are fabricated from different magnetic materials having different magnetic properties.

6. The magnetic component assembly of claim 1, wherein the first magnetic core piece is fabricated from an amorphous powder material.

7. A method of forming a magnetic component, the component including first and second magnetic core pieces and at least first and second pre-formed winding clips separately fabricated from the first and second magnetic core pieces, the first and second pre-formed winding clips including a flat conductor formed substantially in a C-shape having a planar main winding section extending in a first plane, opposing first and second legs extending substantially perpendicular to the first plane, and first and second terminal lead sections respectively extending from each of the first and second legs, the first and second terminal lead sections extending in a plane spaced from but parallel to the first plane and the first and second terminal lead sections extending inwardly toward one another, the first and second terminal lead sections configured for surface mounting, the method comprising:

coupling the first pre-formed winding clip to the first magnetic core piece without shaping any portion of the winding clip about the first magnetic core piece;

assembling the coupled first pre-formed winding clip and first magnetic core piece to the second magnetic core piece, whereby the first and second magnetic core piece collectively surround and enclose a portion of the first pre-formed winding clip;

wherein the first magnetic core piece includes a first clip channel and the second magnetic core piece includes a second clip channel, and wherein coupling the first pre-formed winding clip to the first magnetic core piece comprises inserting a portion of the first pre-formed winding clip into the first clip channel, and wherein assembling the coupled first pre-formed winding clip and first magnetic core piece to the second magnetic core piece comprises inserting a portion of the first pre-formed winding clip into the second clip channel;

wherein the second magnetic core piece further includes a third chip channel opposing the second clip channel and wherein the component further includes a third core piece having a fourth clip channel; and the method further comprising inserting a portion of the second pre-formed winding clip into the third clip channel and inserting a portion of the second pre-formed winding clip into the fourth clip channel.

8. The method of claim 7, wherein the pre-formed winding clip defines an interior cavity, and coupling the pre-formed winding clip to the first magnetic core piece comprises inserting a portion of the first magnetic core piece into the interior cavity.

9. The method of claim 7, wherein the pre-formed winding clip is substantially C-shaped, and one of the first and second magnetic core pieces is U-shaped.

10. The method of claim 9, wherein both of the first and second magnetic core pieces are U-shaped, and each of the U-shaped core pieces receives a portion of the respective first and second pre-formed winding clips.

* * * * *

UNITED STATES PATENT AND TRADEMARK OFFICE

CERTIFICATE OF CORRECTION

PATENT NO. : 8,400,245 B2
APPLICATION NO. : 12/535981
DATED : March 19, 2013
INVENTOR(S) : Yipeng Yan et al.

It is certified that error appears in the above-identified patent and that said Letters Patent is hereby corrected as shown below:

Specification

In Column 18, Line 6, delete "21A" and insert -- 22A --, therefor.

In Column 18, Line 10, delete "21" and insert -- 22A --, therefor.

In Column 18, Line 13, delete "21B" and insert -- 22B --, therefor.

In Column 18, Line 19, delete "21" and insert -- 22B --, therefor.

In Column 18, Line 22, delete "21C" and insert -- 22C --, therefor.

Signed and Sealed this
First Day of March, 2016

Michelle K. Lee

Michelle K. Lee
*Director of the United States Patent and Trademark Office*